United States Patent [19]

Blaschke et al.

[11] 4,202,416

[45] May 13, 1980

[54] METHOD AND APPARATUS FOR SINKING A CASED BOREHOLE FOR PRODUCING CASED PILE FOUNDATIONS

[75] Inventors: Kurt Blaschke, Saarbrücken-Dudweiler; Josef Roob, St. Wendel, both of Fed. Rep. of Germany

[73] Assignee: Stahl- und Apparatebau Hans Leffer GmbH, Saarbrücken-Dudweiler, Fed. Rep. of Germany

[21] Appl. No.: 931,723

[22] Filed: Aug. 7, 1978

[51] Int. Cl.[2] ..... E21B 3/08; E21B 3/10

[52] U.S. Cl. ..... 175/94; 173/33; 175/171; 175/292; 405/232

[58] Field of Search ..... 405/232, 240, 241, 243, 405/244, 245, 303, 231; 175/7, 94, 171, 103, 292; 173/33

[56] References Cited

U.S. PATENT DOCUMENTS

| | | | |
|---|---|---|---|
| 1,779,575 | 10/1930 | Wilson | 175/292 |
| 2,838,285 | 6/1958 | Gredell | 175/391 |
| 2,873,950 | 2/1959 | Kandle | 175/94 |
| 2,912,228 | 11/1959 | Kandle | 175/292 |
| 2,951,131 | 9/1960 | Lyroudias | 405/243 |
| 2,990,896 | 4/1961 | Kandle | 175/171 |
| 3,032,128 | 5/1962 | Walton | 175/292 |
| 3,385,383 | 5/1968 | Sturgeon | 175/292 |
| 3,467,203 | 9/1969 | Johnson | 175/171 X |
| 3,491,842 | 1/1970 | Delacour et al. | 175/171 X |
| 3,693,734 | 9/1972 | Richmond | 175/122 |
| 3,734,214 | 5/1973 | Benetti et al. | 175/384 |

FOREIGN PATENT DOCUMENTS 1094201 12/1967 United Kingdom .

*Primary Examiner*—Dennis L. Taylor
*Attorney, Agent, or Firm*—John J. Dennemeyer

[57] ABSTRACT

Method for sinking a cased borehole for producing cased pile foundations. The method uses an apparatus comprising a crane, a drilling appliance capable of being lowered into the borehole and a tube extraction machine with double-acting lifting cylinders for increasing the drilling pressure and for extracting the drop tube after the pile has been concreted. The drilling appliance is capable of producing a borehole with a larger diameter than that of the drop tube and can be fixed to the drop tube by means of a clamping device for withstanding the torque of the motor used for driving the drilling tool. In the method, the drop tube is axially secured and is prevented from locating with respect to the ground, a section of borehole having a greater diameter than the diameter of the drop tube is drilled, and subsequently the axial securement of the drop tube is released so that the drop tube slides downwards by a length corresponding to the length of the section of borehole drilled.

Apparatus for performing the method is also described.

5 Claims, 16 Drawing Figures

Figures 1, 2:
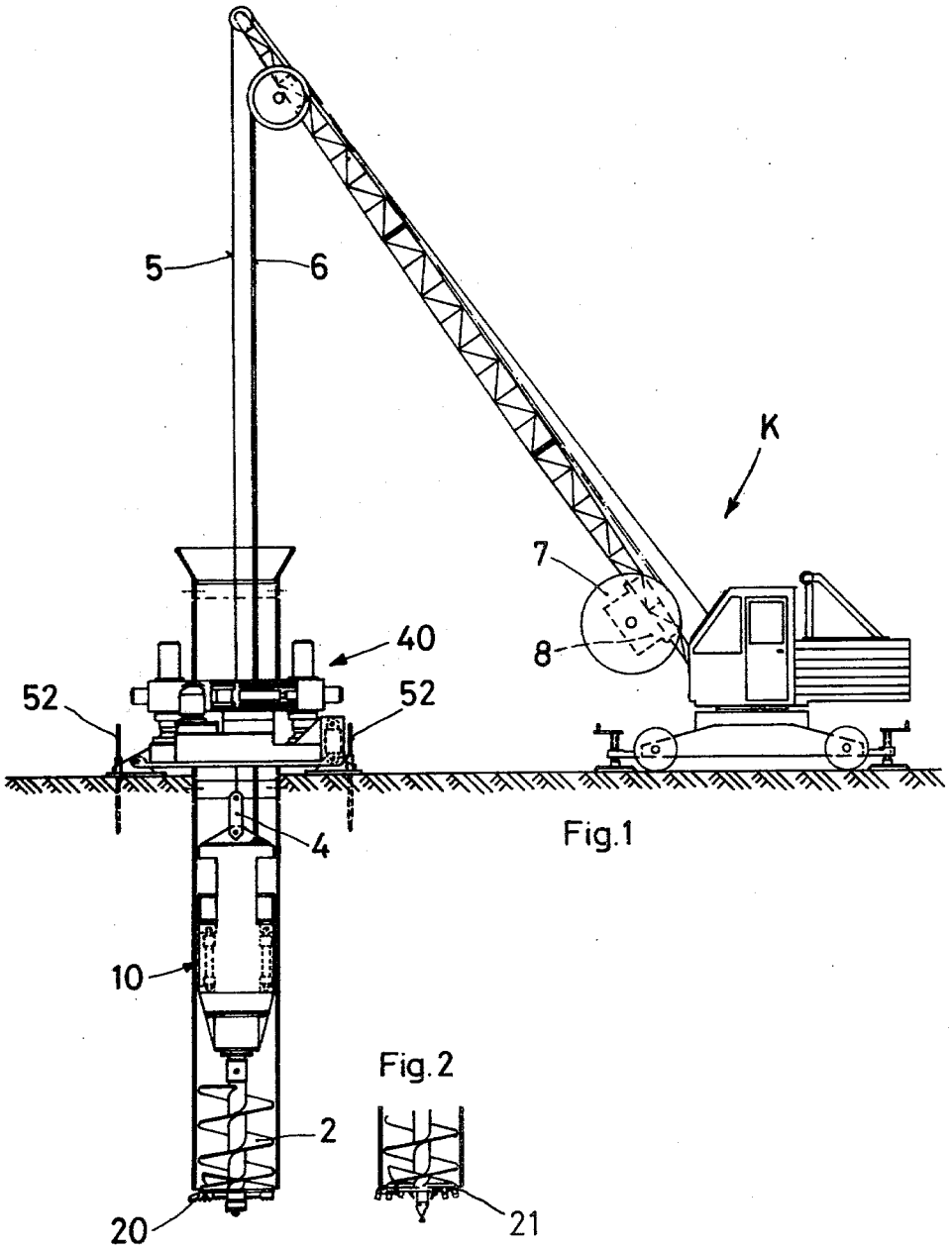

2
3
2a
229
230
210
27
225'
212
214
27
26
24a
25
24b
29

„x"
26
29
224
210
223

XII
XIII
226
222
213
221

213
XIII
222
221

216
214
212
28
X
211
24
220
24a
24b
26
225
25'
226
24c
213
215
217
218

X
„x"
213
226
226'

227
2a
26
24c'
27

METHOD AND APPARATUS FOR SINKING A CASED BOREHOLE FOR PRODUCING CASED PILE FOUNDATIONS

The invention relates to a method and apparatus for sinking a cased borehole for producing cased pile foundations. Previously known methods and apparatus of this type fulfil their function, which in some respects are too expensive or can only be used for limited depths of borehole or limited diameters of the drop tube.

A known method operates with a vibrating pile driver, which must be connected to the drop tube to be driven in, by a movable tamping machine or a movable crane, according to its size. The borehole is drilled by a special drilling appliance.

Furthermore, it is customary to drill by means of drilling rods and a drill head, which can be exchanged by a gripping device or is combined with the latter. With greater depths of borehole, the drilling rods must be extended in sections. To insert the drop tubes, a second mobile appliance with gripping arms which can be raised and lowered is necessary, which drives the drop tubes into the ground by moving the gripper arms downwards. In this case, it is not possible to exert a greater force than that allowed by the weight of the second vehicle, so that it is not possible to case the borehole to a greater depth. On the other hand, it is easy to produce oblique boreholes, since for guiding the drilling rods, the so-called Kelly rod, the drilling head can be placed in an oblique position as easily as the gripping and driving device on the second vehicle.

Other drilling installations in particular for pile foundations of large diameter have a single mobile crane with a special construction, which can be used both for drilling, casing or chiselling. Located on the derrick is a drilling table, which is equipped both for the rotation of a drilling rod with a drilling tool as well as for the reciprocating movement of the drop tube to be driven in. Instead of drilling with drilling rods, a drilling claw or bit can be operated by the crane in order to drill the hole in the ground and remove the excavated material. The bit is used when the drill is located on hard rock. The method of operation with the bit causes considerable vibrations which are a disturbance to the environment. Apart from the drilling claw and bit, augers, buckets or sludge balers are used as drilling tools.

To produce inclined boreholes, the derrick must be tilted, whereby the mobile crane becomes a decidedly expensive special vehicle.

In recent years, drilling rigs of the aforesaid type have been developed as regards sinking the drop tubes by using hydraulic casing machines or rotating shafts. Drilling rigs with rotating shafts are disclosed in German Patent Specifications Nos. 1 171 848, 1 231 634 and German Auslegeschrift No. 1 215 624. In practice, these rotating shafts are generally designed as attachments for the crane vehicle and in every case represent an expensive unit. The clamping collar of a hydraulic casing machine can be supported on the ground by way of double-acting hydraulic cylinders, in order to be use for drawing out the drop tube sunk in the earth or for increasing the drilling pressure, when drilling is carried out with a drilling appliance able to be lowered into the borehole, which drilling appliance can be attached to the drop tube by means of a clamping device for withstanding the torque of the driving motor or the drilling tool (German Patent Specification No. 1 171 848). Internal drilling appliances of this type are also known from German Patent Specification No. 842 932 and German Offenlegungsschrift No. 2 234 611. They are introduced into the borehole by a supporting cable and are secured to the drop tube by means of a controllable clamping device, which is guided axially with a limited stroke, but in a non-rotary manner on the housing supporting the drive motor and the drilling tool, the power and control leads entering the drilling appliance from above.

For drilling into hard rock, a rotary cutter head has been developed with a double wing-shaped bit support, which is provided with diametrically located swinging wings likewise provided with drill bits, which wings, in a working position swung radially outwards and limited by a stop, cut with their bits free of the bit support and return to their inner inoperative position when the direction of rotation is reversed (German Patent Specification No. 2 242 724). A rotary cutter head of this type makes it possible to drill a borehole with a greater diameter than that of the drop tube. For drilling boreholes which are larger than the drop tube, special implements in the manner of drilling claws are known, but which can only be used for soft ground and serve to enlarge the end of the borehole in a conical shape in order to provide better support and anchorage for the concrete pile to be produced at the lower end.

As regards the prior art, it should also be mentioned that special cube extraction machines are known, with a hydraulically actuated clamping collar which can be raised and lowered (German Auslegeschrift No. 1 259 811).

The invention intends to provide a simplified method and an accordingly simplified apparatus for sinking a cased borehole for producing cased pile foundations. The new method can be carried out by an apparatus which consists of conventional units, as aforedescribed with regard to the prior art and which were selected for carrying out the new method. An apparatus of this type, on which the invention is based as regards the method, consists of a crane, a drilling appliance able to be lowered into the borehole, which is set up to produce a borehole having a greater diameter than that of the drop tube and which can be connected to the drop tube by means of a controllable clamping device for withstanding the torque of the driving motor for the drilling tool and of a tube extraction machine with double-acting lifting cylinders for increasing the drilling pressure and for extracting the drop tube after concreting the pile. The method according to the invention is characterized by the steps which are described below. The known units selected from drilling technology are thus applied and used within the framework of the invention such that the drop tube slides downwards in the drilled borehole under the load of a weight. To increase the weight loading of the drop tube, the machine frame of the tube extraction machine can be lifted up from the ground with the clamping collar clamped to the drop tube, so that the entire weight of the tube extraction machine is applied to the drop tube.

Since the diameter of the borehole is drilled so large that the drop tube slides downwards under the weight, the positive guidance of the drop tube in the earth which was provided in the previous casing method, is no longer reliably ensured. For this reason, as it slides downwards, the drop tube is guided by the pipe extraction machine, for example in that the clamping or extraction collar is only open to such an extent that the drop tube is axially free, but is still guided.

An apparatus for carrying out the method according to the invention is discussed herein. In this apparatus, an auger with a preceding rotary cutter head is used as the drilling tool, as was developed further in German patent application No. P 27 09 030.8 as regards the inclined return strips on the diametral swinging wings of the cutter head, in order to ensure that when raising the drilling appliance together with the excavated material, the swinging wings tilt back by abutting against the lower end face of the drop tube. The known pipe extraction machine was modified to the effect that the clamping or extraction collar is guided in parallel with the vertical lifting cylinders and can be raised and lowered, in order that the drop tube which slides downwards is guided in a predetermined manner by the guided clamping collar and does not extend in the enlarged drill hole. Means are also provided in order to secure the pipe extraction machine in a non-rotary manner with regard to the ground, in order to support the torque of the driving motor of the drilling apparatus on the ground by way of the drop tube and the pipe extraction machine, if the friction existing between the pipe extraction machine and the ground is not sufficient.

If the lifting cylinders of the pipe extraction machine are able to be actuated even when the clamping collar is released, there is a possibility of raising the released clamping collar, clamping it to the drop tube and raising the machine frame from the ground by retracting the lifting cylinders, so that the entire weight of the tube extraction machine is applied to the drop tube as regards weight—without losing its positive guidance with regard to the ground.

The drilling installation according to the invention is developed further within the framework of the claims. Certain elements are the subject of the former patent application No. P 27 22 075.3 and serve to act on the drilling tool with an additional drilling pressure from the two lifting cylinders, which pressure is reinforced by the weight of the drilling tube and the tube extraction machine. In this connection it is recommended that the machine frame of the tube extraction machine forms a unit with a hydraulic device and all the additional equipment for supplying and actuating the lifting cylinders and the clamping cylinder or cylinders of the clamping collar in order to make the latter heavy. It may also be provided with additional weights.

Inclined boreholes can be produced in a simple manner due to the face that the clamping or extraction collar of the tube extraction machine is arranged in a pivotal manner on the machine frame.

Furthermore it is an advantage if the rotary cutter head provided with round bits can be exchanged for a rotary cutter head provided with spade-like bits for soft earth. Spade-like bits of this type are described in U.S. Pat. No. 2,968,880.

Figure 5:
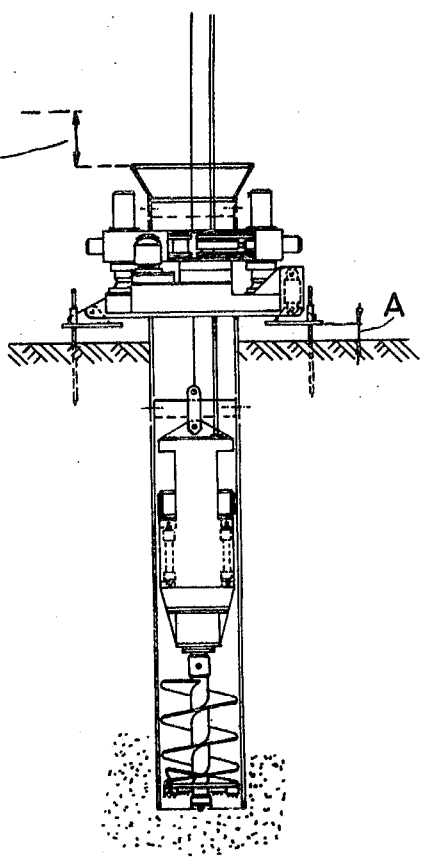
Figure 4:
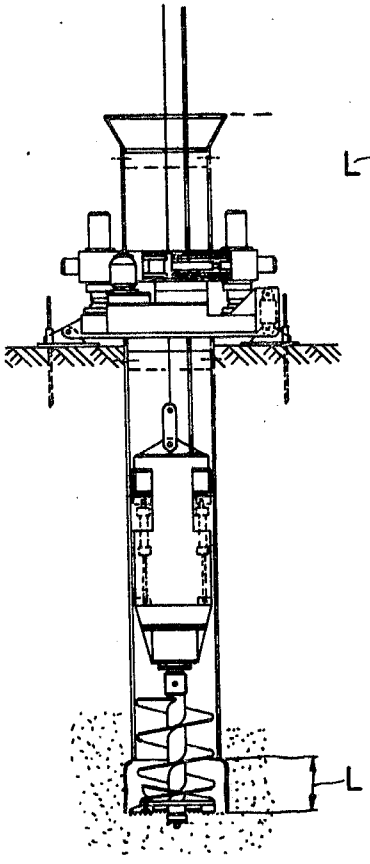
Figure 3:
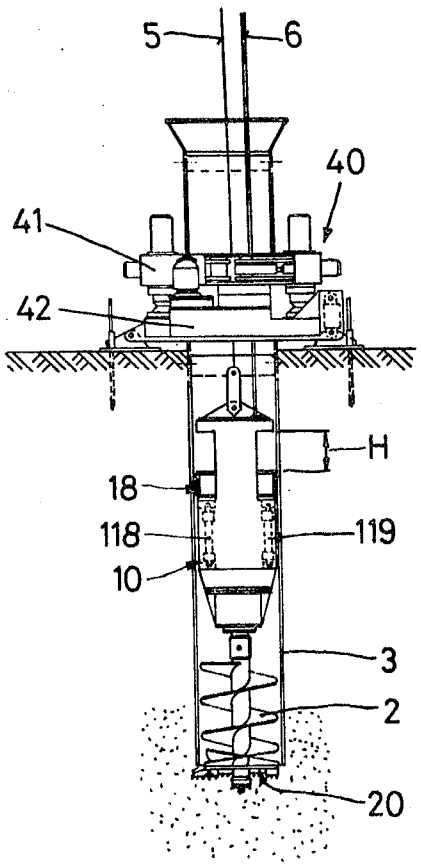
Figure 6:
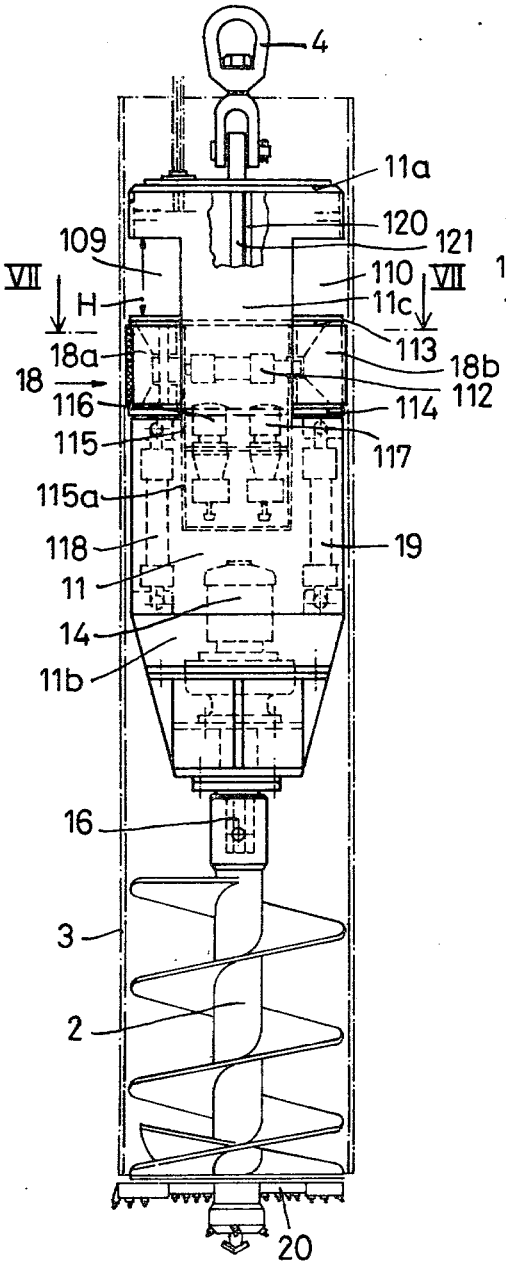
Figure 7:
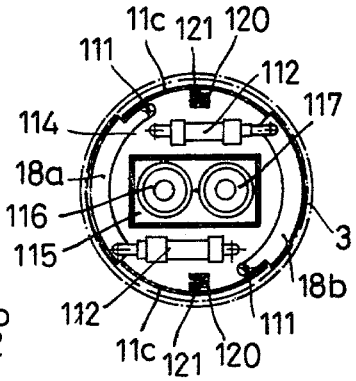
Figures 8, 9, 10, 11, 12, 13, 14:
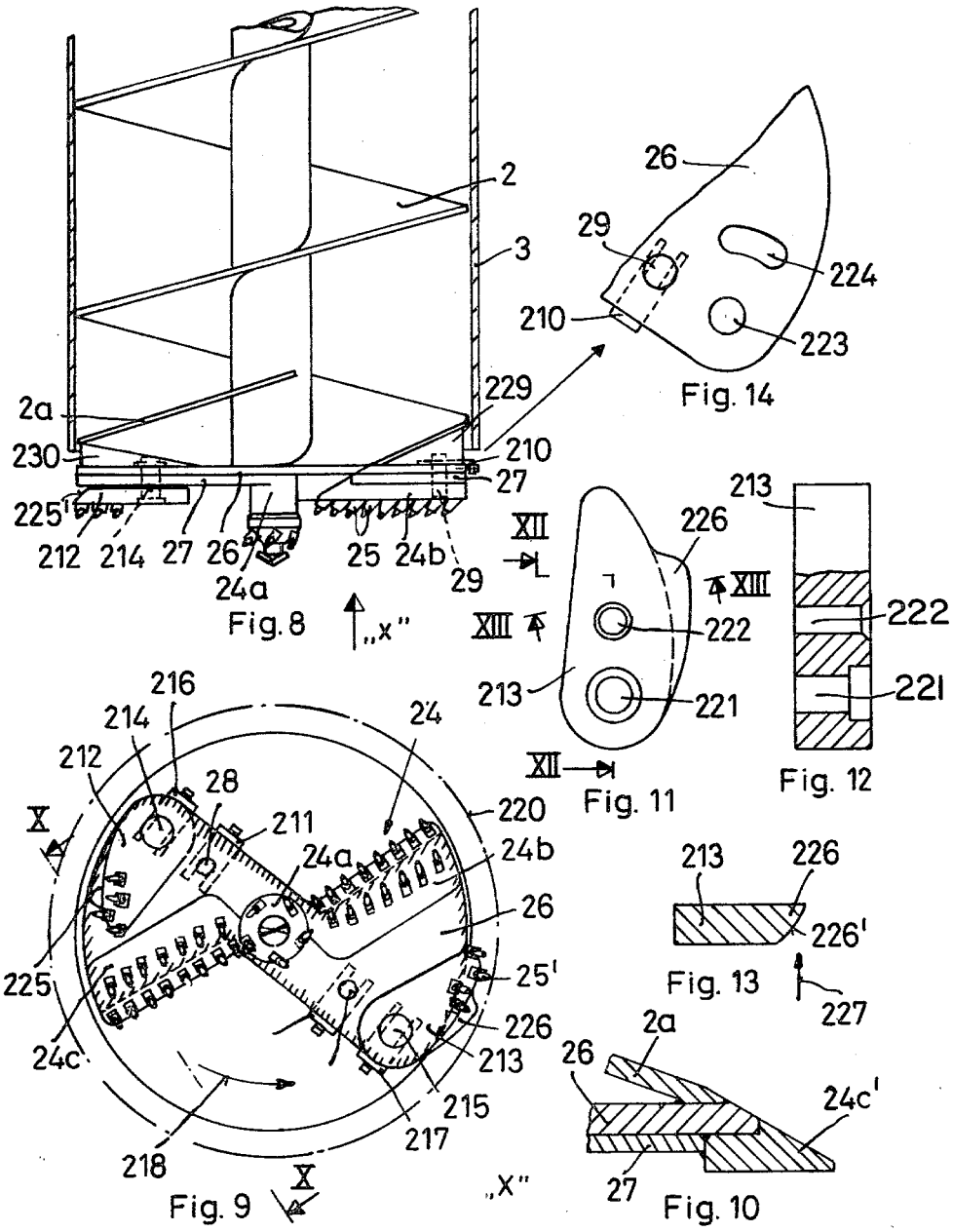
Figure 15:
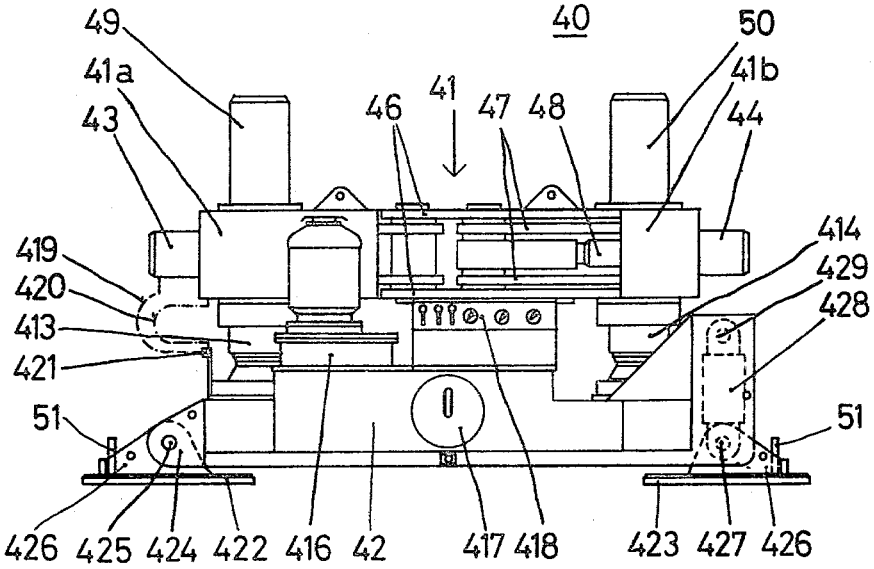
Figure 16:
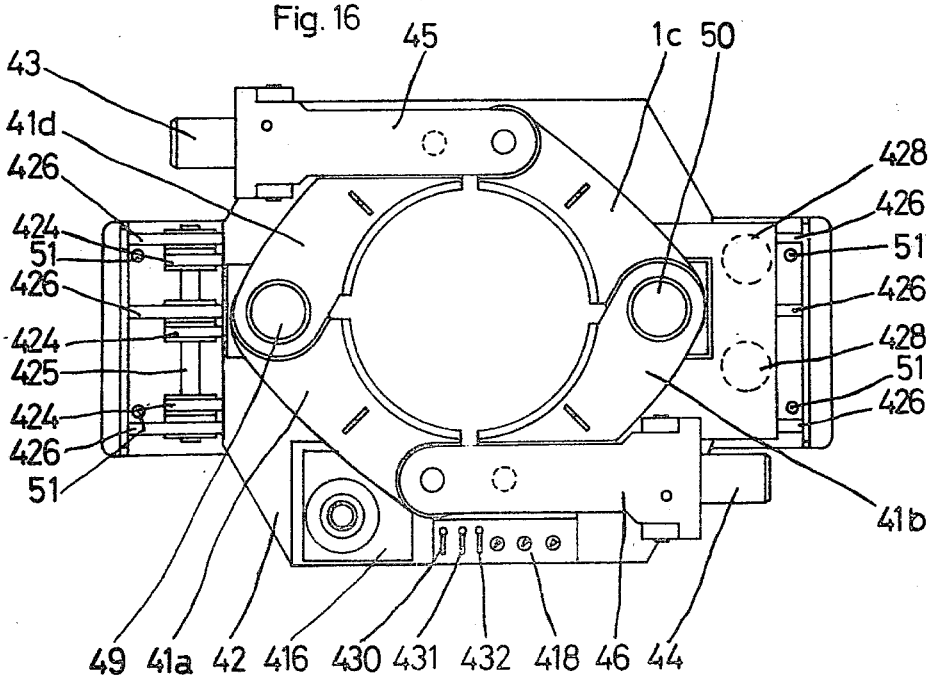

One embodiment of an apparatus for sinking a cased borehole according to the invention is illustrated in the drawings and in particular FIG. 1 shows the entire apparatus with an internal drilling appliance comprising a rotary cutter head for hard rock, lowered into a drop tube, FIG. 2 is a partial view according to FIG. 1 with a replacement rotary cutter head for soft earth, FIGS. 3 to 5 show the drilling and casing apparatus according to FIG. 1 without the crane in order to illustrated the various stages of the method, FIG. 6 shows the internal drilling apparatus to an enlarged scale and in side view, FIG. 7 is a cross-section on line VII—VII of FIG. 6, FIG. 8 is an enlarged illustration of the auger and the rotary cutter head preceding the latter, according to FIG. 6, in axial section through the last drop tube, FIG. 9 is a view of the rotary cutter head from below in the direction of arrow "X" of FIG. 8, FIG. 10 is a section on line X—X of FIG. 9, FIG. 11 shows a detached swinging wing without the round shafted bit in plan view, FIG. 12 is a section on line XII—XII of FIG. 11, FIG. 13 is a section on line XIII—XIII of FIG. 11, FIG. 14 shows part of the base plate in the region of the mounting for a swinging wing, FIG. 15 shows a tube extraction machine in side view and FIG. 16 shows the tube extraction machine in plan view.

The apparatus illustrated in FIG. 1 consists of a crane K, an internal drilling appliance 10 with an auger 2 and rotary cutter heads 20, lowered into the drop tube 3 and of a tube extraction machine 40. The internal drilling appliance 10 is connected by a crane harness 4 to the lifting cable 5 of the crane. Power and control lines 6 enter the inner drilling appliance 10 from above, which lines come from a drum 7 of the crane K. The power and control lines 6 are ultimately introduced into a distributor 8.

Before the method of operation illustrated in FIGS. 3 to 5 is discussed, the individual units used in the embodiment will be described hereafter as follows:

FIG. 6 shows the internal drilling appliance lowered in a drop tube 3, with a steel cylinder 11 fitting in the drop tube, which on its upper closure plate **11*a* supports a crane harness 4 for attaching the support cable 5 of the crane K or a winch. On the underside, the steel cylinder 11 passes into a tapered housing suction 11*b* which receives a drive motor 14 as a drive for the auger 2. The auger 2 is connected to a bearing 16 of the driver motor 14**.

In the upper region of the steel cylinder 11, a clamping device 18 is able to move axially with a working stroke H, but is guided in a non-rotary manner. To this end, in the region of the clamping device and its working stroke H, the steel cylinder is provided with recesses 109 and 110 for the passage of two diametral clamping jaws **18*a* and 18*b*, between which recesses diametral portions of wall 11*c* remain. The two clamping jaws 18*a*, 18*b* are respectively pivotally mounted on a pivot 111 and can be moved outwards and back inwards respectively by means of a hydraulic clamping cylinder 112. The pivot shafts 111 extend between two support plates 113 and 114, located at a distance apart, which are the supporting members of the clamping device 18. As can be seen most clearly from FIG. 7, the lower support plate 114 supports the clamping cylinder 112. On the other hand, both support plates 113, 114 are provided with corresponding recesses, in which a rectangular inner container 115 is inserted, to whose four walls the support plates are welded. The inner container 115 serves to receive two pump units 116 and 117 consisting of motor and pressure pump. The pump unit supplies the pressure oil for the lifting cylinders 118, 119, whereas the other unit 117 supplies the clamping cylinder 112. The inner container 115 has a lower container part 115*a*, which receives the pressure oil for both pump units. If, when using the rinsing method for removing the excavated material at the time of drilling, no electrical leads carrying high voltage are to pass through the inner drilling apparatus 10, the pump units 116 and 117 as well as the valve controls are located in the distributor 8 of the crane (FIG. 1**) in which case the power conduits carry pressure oil and control leads are dispensed with.

Located outside the inner container 115 inside the steel cylinder 11 and parallel to the borehole are double-acting lifting cylinders 118 and 119, which are attached at their upper end to the lower support plate 114 of the clamping device 18 and at their lower end to the steel cylinder 11, respectively its housing part 11*b*. Thus, these lifting cylinders 118, 119 are active between the axially movable clamping device 18 and the housing part 11*b* receiving the drive motor 14 and supporting the auger 2 and enable the clamping device to move to and fro over its working stroke H.

The supporting moment of the drive motor 14 must be absorbed at the time of drilling by way of the clamping device 18 by the drop tube 3, which is stationary at the time of drilling and is retained by the clamping collar of the tube extraction machine 40. Rotation is therefore prevented between the clamping device 18 and the steel cylinder 11, which prevention is effective at least in the direction of rotation of the supporting moment of the drive motor 14. The device for preventing rotation of this type consists of two diametral stop blocks 120, which extend between the support plates 113, 114 and diametral bars 121, which are attached to the inner wall of the steel cylinder 11 and against which the stop blocks 120 bear, when, with the clamping jaws 18*a*, 18*b* controlled outwards and the clamping device 18 thus fixed to the drop tube 3, the drive motor 14 for the auger 2 is switched on and its supporting moment attempts to rotate the steel cylinder 11. In FIG. 6, the upper edge of the steel cylinder 11 is shown partly cut away, in order to show clearly the stop blocks 120 with the stop bar 121 located on the underside in FIG. 7. It will be understood that in place of the stop blocks 120, U-shaped guides could be provided, which prevent rotation in both possible relative directions of rotation of the steel cylinder 11 with respect to the clamping device 18.

FIG. 8 shows the last threads of the auger 2, which in its last thread is constructed with two threads by means of an additional second half screwthread 2*a*. The auger with the rotary cutter head 20 located at the lower end is shown in the working position, which is indicated by the last drop tube 3.

The rotary cutter head firstly comprises a double wing-shaped bit support 24 (FIG. 2) with a central spindle 24*a* and the two wings 24*b* and 24*c*, which are all provided in known manner with bits 25 having a round shaft. The bit support 24 is attached on the underside to a base plate 26, which is connected in a non-rotary but detachable manner to the auger in a manner which is not shown in detail, and likewise has a double winged shape as shown in FIG. 9 by shading starting from the periphery.

As shown in FIG. 10 for one wing 24*c* of the bit support, the associated helical surface 2*a* is welded to the base plate 26 at the outlet and continues as an inclined pilot cutting edge 24*c*' of this bit support wing. In a similar manner, the helical surface 2 with its last thread continues beyond the base plate 26 in an inclined pilot cutting edge of the wing 24*b*. The pilot cutting edge 24*c*' shown without round shafted bits in FIG. 10 is in one piece with a support plate 27 belonging to the bit support 24, beneath which plate 27 the base plate 26 is placed virtually coinciding with its double wing-shaped formation. The bit support 24 with the support plate 27 is thus constructed as a detachable part with regard to the base plate 26 and is connected to the base plate 26 such that it can be exchanged by means of two bolts 28, 29 passing through the base plate 26 and transmitting the torque. FIG. 14 shows part of the base plate 26 in the region of the bolt 29, which passes from below through the support plate 27 and the base plate 26 and is secured by a fork-like bar 210, which engages in a recess in the bolt 29. In a similar manner, the bolt 28 is secured by a fork-like bar 211. Since the base plate 26 is connected in a non-rotary manner to the shaft of the auger, the two bolts 28 and 29 transmit the torque to the double wing-shaped bit support 24.

The regions of the double wing-shaped base plate 26 not taken up by the wings 24*b* and 24*c* of the bit support 24 comprise diametrally located swinging wings 212, 213, which are mounted to pivot on pivots 214 and 215 parallel to the axis of rotation of the bit support 24. Fork-like bars 216, 217 likewise serve to secure the position of the swinging wings 212, 213 so that the swinging wings 212, 213 are likewise mounted so that they can be detached and exchanged.

The swinging wings 212, 213 likwise provided with round shafted bits extend from their pivot shafts 214, 215 in the direction of rotation of the rotary cutter head, which is indicated by the arrow 218. Owing to the resistance which the round shafted bits encounter on the earth or on the rock formation during rotation of the rotary cutter head, the rotating wings 212, 213 swing outwards and thus have a free cutting action with respect to the bit support 24. In FIG. 9, only the swinging wing 213 has swung outwards, so that its outermost round shafted bit 25' describes a drilling circle 220. The swinging wing 212 is illustrated in the return position.

Both the swung out position of the swinging wing 213 as well as the return position of the swinging wing 212 are limited by stops. In conjunction with FIG. 12, FIG. 11 shos fthat apart from a bore 221 for receiving the pivot shaft 215, which also passes through a bore 223 in the base plate 26 (and naturally also in the support plate 27), the swinging wing 213 comprises an eccentric bore 222, through which a stop pin can be inserted, which engages as far as a curved slot 224 in the base plate 26. The adjustment of this stop pin (not shown) in the curved slot 224 determines the swinging range of the swinging wing 213.

Wedge shaped return strips 225, 226 are formed on the radially outer sides of the swinging wings 212, 213, which strips are located inside the outermost drilling circle 220 and therefore do not interfere at the time of drilling. The return strip 226 shown in section in FIG. 13 has a side face 226' ascending radially in the drilling direction 227. In conjunction with FIG. 13, the drilling direction 227 is therefore directed upwards, because the swinging wing 213 illustrated in FIG. 11 is shown from below, i.e. in the direction of arrow "X" according to FIG. 8. Therefore, for the swinging wing 212 in FIG. 8, its inclined side wall 225' extends in the reverse direction. These inclined side walls 225' and 226', respectively the return strips 225, 226 forming the latter, have the effect that on retracting the auger 2 and the rotary cutter head 20 attached thereto, the loose earth or rock exerts a pressure on the surfaces 225' and 226' with the result that force components directed radially inwards are produced as restoring pulsers for the swinging wings 212 and 213. It is thus ensured and the limitation of the tilted positions for the swinging wings is designed accordingly, that on raising the drilling apparatus 10, the swinging wings swing back reliably within the inner diameter of the drop tube 3, as illustrated in FIG. 9 for the swinging wing 212.

On returning to FIG. 8 it will be noted that the swinging wings 212, 213 with their pivot pins 214, 215 are mounted below the screwthreads 2, respectively 2a, starting from the base plate 26, i.e. in wedge-shaped spaces, which can be easily blocked by earth and detached pieces of rock. In order to keep the pivotal mountings for the swinging wings operative, these wedge-shaped spaces between the screwthreads and the base plate in the region of the pivotal mountings for the swinging wings are protected from the entry of earth or pieces or rock by wedge-shaped sheet metal plates 229 and 230 extending axially and in the shape of a circular arc. FIG. 8 shows the outer surface of the sheet metal plate 229, whereas the inwardly directed surface of the sheet metal plate 230 is shown.

The most essential parts of the pipe extraction machine 40 illustrated in FIGS. 15 and 16 are a clamping collar 41 as well as a machine frame 42 adjacent the ground. In the embodiment, the clamping collar 41 consists of four segments 41a, 41b, 41c and 41d, which are actuated in known manner by two clamping cylinders 43 and 44. The clamping cylinders 43 and 44 are attached to pull straps 45 and 46, which are pivotally connected to the segments 41a and 41c, whereas the piston rod 48 of the cylinder 44 is connected to the straps 47 of the segment 41b. The same is true for the cylinder 43 as regards the segments 41c and 41d. When the piston rod 48 is extended from the clamping cylinder 44, the segment 41a tilts in counterclockwise direction under the pulling force of the pull straps 46 and the segment 41b tilts in clockwise direction about the pivot points 49 and 50 under the pushing force of the piston rod 48. Since in a similar manner, the segment 41c is tilted in counterclockwise direction and the segment 41d in clockwise direction, under the action of the clamping cylinder 43 and the pull straps 45 as well as the straps 47 which are not visible, a drilling tube inserted in this way in the opening of the clamping collar 41 can be clamped.

The pivot points for all the clamping segments are formed by vertical lifting cylinders 49 and 50, which are attached axially to the clamping collar 41. The piston rods 413 and 414 can be extended downwards and connected to the machine frame 42. By extending the piston rods 413, 414 a drilling tube clamped by the clamping collar 41 can be extracted gradually from the ground.

The machine frame 41 is constructed as a standard component, with a hydraulic unit 416 an oil container, of which the closure cover 417 can be seen, with valve controls (not shown) and pressure lines for supplying the lifting cylinders 49, 50 as well as the clamping cylinders 43, 44 of the clamping collar 41 and with a control panel 418. The entire pressure unit including the controls are supported, respectively received by the machine frame 42, so that only one electrical power lead leads to the tube extraction machine.

FIG. 15 shows two flexible lines 419, 420 for actuating the clamping cylinder 43, which lines can be connected at 421 to the output of pressure lines, which are fixed in the machine frame 42. A corresponding pair of flexible pressure lines also leads to the clamping cylinder 44.

At its narrow ends, the machine frame 42 is provided with rotary pressure shoes 422 and 423. On the side of the pressure shoe 422, the machine frame 42 supports three bearing blocks 424, for a pivot shaft 425, which passes through three cross pieces 426 of the pressure shoe 422. This provides the rotary movement of the pressure shoe 422 with respect to the machine frame 42. The pressure shoe 423 on the other side of the machine frame 42 likewise supports three cross pieces 426, through which a pivot shaft 427 is guided. Attached to this pivot shaft 427 are two tilting cylinders 428, which are pivotally supported on the machine frame 42 by way of an upper pivot 429. When the tilting cylinders 428 are actuated, the machine frame 42 together with the clamping collar 41 can be tilted about the shaft 425, in order to be able to extract or introduce drop tubes inserted obliquely in the ground.

The control panel 418 has three actuating levers 430, 431 and 432 for the independent actuation of the clamping cylinders 43, 44, the lifting cylinders 49, 50 and the tilting cylinders 428. The lifting cylinders 411, 412 are double-acting, in order to be able to use the tube extraction machine not only for extracting tubes, but also for increasing a downwardly directed force acting on the drop tube. If the clamping collar 41 is raised in the released condition by extending the piston rods 413, 414 and then clamped to the drop tube, their reverse actuation of the lifting cylinders 49, 50, the piston rods 413, 414 connected with considerable tension to the machine frame 42 can be retracted, due to which the entire machine frame 42 is raised from the ground and its weight is added to the drilling tube.

The pressure shoes 422, 423 are provided with vertical guides 51, through which anchoring bolts 52 can be driven into the ground (FIG. 1), the primary function of which is to prevent the tube extraction machine 40 from rotating with regard to the ground. However, the anchoring bolts 52 with their guides 51 may also fulfil the function of guiding the drop tube 3 axially when the clamping collar 41 is tightened, if the machine frame 42 is raised from the ground in order to increase the load on the drop tube, when the clamping collar is attached in an elevated position. This guidance is indispensable, since the borehole is drilled to an excess size and the drop tube is not guided in an exact manner in the borehole. The guides 51 must be located on the machine frame 42, if inclined holes are to be produced and cased.

The method of operation of the aforedescribed apparatus will now be described with reference to FIGS. 3 to 5. FIG. 3 shows an initial position in which the internal drilling apparatus 10 is introduced into the drop tube 3 by the cable 5 to such an extent that the rotary cutter head 20 of the auger 2 is at the bottom of the borehole. The lifting cylinders 118, 119 are retracted so that the clamping device 18 is in a lower position relative to the housing 11 of the drilling apparatus. Then, the clamping cylinders 112 (FIG. 7) are actuated and thus the internal drilling apparatus 10 is prevented from rotating on the drop tube 3. The drop tube 3 itself is prevented from rotating by the tightened clamping collar 41 of the tube extraction machine 40, especially since the tube extraction machine 40 is fixed in a non-rotary manner by means of the anchoring bolts 52 driven into the ground (FIG. 1).

After the drive motor 14 of the internal drilling apparatus 10 has been started, the rotary cutter head 20 drills a partial borehole having a maximum length of L (FIG. 4), which corresponds to the stroke H (FIG. 3) between the housing 11 of the drilling apparatus 10 and the secured clamping device 18. During this drilling operation, the swinging wings 212, 213 of the rotary cutter head 20 swing outwards (FIG. 9) and enlarge the borehole to the drilling circle 220, which is clearly several centimeters larger than the outer diameter of the drop tube 3. This enlarged borehole is shown in FIG. 4. During drilling, the lifting cylinders 118, 119 are extended, so that drilling takes place under an additional active drilling pressure from the lifting cylinders. The reaction force of the drilling pressure is received by the weight of the internal drilling apparatus 10, of the drop tube 3 and of the tube extraction machine 40 fixed to the drop tube, for which purpose the double-acting lifting cylinders 49, 50 (FIG. 15) are locked hydraulically or the clamping collar 41 is fixed to the drop tube in the raised position and extreme position of the lifting cylinders.

After drilling a section of the borehole, a casing step begins. Firstly, the internal drilling apparatus 10 is raised. In this case, the return strips 225, 226 (FIG. 9) of the swinging wings 212, 213 of the rotary cutter head 20 strike against the lower end face of the drop tube 3 and are thus pushed inwards, which can be assisted by the fact that the direction of rotation 218 of the cutter head 20 is reversed. If, after this process which is not shown, the rotary cutter head 20 has been retracted into the drop tube 3, the clamping collar 41 of the tube extraction machine 40 is loosened to such an extent that the drop tube 3 begins to slide downwards. In this case, the internal drilling apparatus 10 can still be clamped by way of the clamping device 18 to the drop tube 3, with the lifting cylinders 118, 119 locked hydraulically and the cable 5 slack, in order to assist the sliding movement of the drop tube 3 in a downwards direction due to its own weight. The drop tube 3 slides downwards by the length L of the drilled borehole, as shown in FIG. 5. FIG. 5 also shows the initial configuration of the internal drilling apparatus 10 before a new drilling operation, i.e. with the lifting cylinders 118, 119 retracted, in which position the clamping device 18 is actuated for once more preventing the latter from rotating with respect to the drop tube.

When drilling in hard rock with the rotary cutter head 20 provided with round bits according to FIGS. 8 to 13, it is not to be expected that soft earth slides downwards during drilling. The borehole of extended diameter with regard to the drop tube is thus maintained with this increased diameter, so that there is no special guidance in the borehole for the drop tube 3 over its length which under certain circumstances is considerable and is obtained by fitting together individual tube sections. For this reason, when the drop tube slides downwards, the clamping collar 41 of the tube extraction machine is only loosened to such an extent that the drop tube 3 begins to slide, but is guided axially by the clamping jaws of the clamping collar having a correspondingly high construction. It should also be noted that when drilling in soft earth with the rotary cutter head 21 according to FIG. 2, earth may slide into the borehole. It is thus recommended that when drilling, the entire stroke H of the internal drilling appliance 10 is not fully utilised, but that drilling is only carried out with smaller drilling lengths than the dimension L and that the drop tube 3 is allowed to slide down more frequently and in smaller steps.

FIG. 5 shows the possibility of suspending the entire weight of the tube extraction machine 40 from the drop tube 3 in order to increase the weight of the drop tube 3 as it slides downwards. Should the drop tube not slide downwards when the clamping collar 41 is open, the clamping collar is raised, fixed to the drop tube and the machine frame 42 of the tube extraction machine is raised from the ground by the extent A by retracting the piston rods 413, 414 (FIG. 15). With this method of operation, as it slides downwards, the drop tube is guided axially by way of the anchoring bolts 52 driven into the ground and their guides 51. The guides 51 are appropriately located on the machine frame 42, if it is intended to drill inclined boreholes by tilting the machine frame 42, by means of the tilting cylinders 428 (FIGS. 15, 16). A new drilling operation can be begun according to FIG. 3 after the tube extraction machine 40 is once more supported on the ground when the drop tube 3 has slid downwards.

It will be understood that from time to time, before a drilling operation, the internal drilling appliance 10 is completely removed from the drop tube 3, in order to remove or strip the excavated material located on the threads of the auger 2. The advantages of the new drilling system with respect to the prior art are obvious: A heavy crane with a special construction is no longer required, since the crane needs to be desired solely for the weight of the tube extraction machine or the internal drilling appliance, according to which ever of the units is the heavier. This crane is naturally also adequate for the weight of a length of pipe. In practice, any mobile crane or excavating machine can be used, but a smaller special crane is recommended, which does not need to be mobile, since it can be towed to the site by any truck.

A casing machine is no longer necessary, since the drop tube is able to slide downwards without a rotary movement. The inclusion of a relatively small rotary shaft attached to the drop tube may be an advantage when laying tubes in soft earth, if, in the case of long sections of borehole drilled, the earth slides into the enlarged borehole and the drop tube no longer slides downwards slowly due to the application of weight. In this case, the rotary oscillations of a rotary shaft could have a favourable effect.

There are no restrictions as regards the depth of the boreholes, since only the length of the support cable and power line have a limiting effect. The extension of drilling rods is also dispensed with.

The elimination of the casing machine also means that a connection between the crane or excavator and the drop tube is no longer necessary, whereby the space requirement is reduced.

No additional apparatus is required to produce inclined boreholes, since solely the clamping collar of the tube extraction machine needs to be tilted with its machine frame. This inclined position is possible in a simple manner in any direction due to the fact that the tube extraction machine is positioned accordingly.

Of the advantages relating to operation, the most considerable progress consists in that even in the case of rock, the operation can be absolutely free of vibrations, since claws and chisels are dispensed with. Also, the costs relating to the wear of these parts are eliminated.

A considerable increase in performance can be achieved due to the fact that the crane can be designed for high speeds, since it is required to move smaller weights than previously.

The drilling rig can be easily adapted to the drilling conditions by simply exchanging the rotary cutter head for hard rock for a cutter head for soft earth.

When using airtight tube connections, it is possible to pass through layers of water without difficulty. It is possible to concrete under dry conditions.

The new drilling system also reduces operating costs, since the high wear of tube connections and tubes in the case of hard ground and long piles, which was inevitable in all known systems, is eliminated due to the fact that neither considerable torque, tensile forces, striking forces, vibratory forces nor eccentric forces and moments of a casing machine act on the drop tubes. The tube connections are only subjected to stress for transmitting the torque of the internal drilling appliance and the weight of the tubes, which may have the effect of simplifying the tube couplings.

We claim:

1. Apparatus for sinking a cased borehole, comprising:

(a) a crane provided with a support cable, (b) a drilling appliance suspended from the cable to be lowered into a borehole, said drilling appliance being provided with a controllable clamping means for supporting the torque of a drive motor for a drilling tool on a drop tube, said clamping means being guided axially over a limited working stroke in a non-rotary manner on a housing supporting the drive motor, drilling tool, and power and control lines introduced into the drilling appliance from above, (c) an auger with a preceding rotary cutter head thereon as the drilling tool being provided with a double wing-shaped bit support with diametrically located swinging wings provided with drilling bits, said wings, in a working position being swung radially outwards and limited by a stop, cutting with their bits being free of the bit support and on reversing the direction of rotation, swinging back into their inner inoperative position, each swinging wing being provided on its radially outermost side face with a return strip inclined upwards in the drilling direction, which strips are located inside the inner diameter of the drop tube used in the inoperative position of the swinging wings, when the latter are swung inwards, and (d) a tube extraction maching located on the ground with a hydraulically actuated clamping collar guided in parallel by at least two double-acting lifting cylinders supported on a machine frame and which can be raised and lowered, vertical guides for anchoring bolts or tubes able to be driven into the ground being provided on the machine frame or on pressure shoes located on the ground, whereby the tube extraction machine is secured in a non-rotary manner above the ground.

2. Apparatus according to claim 1 wherein located between the clamping means of the drilling appliance and the housing supporting the drive motor and the drilling tool and extending parallel to the borehole are double-acting lifting cylinders which push the housing downwards when the clamping means is operative.

3. Apparatus according to claim 2 wherein the machine frame of the tube extraction machine forms a unit with a hydraulic unit, an oil container, valve controls and with pressure lines for supplying the lifting cylinders and the clamping cylinder or cylinders of the clamping collar as well as with a control panel.

4. Apparatus according to claim 3, wherein the machine frame is provided at two opposed ends with pressure shoes able to rotate about parallel shafts, wherein the shafts of one pressure shoe are pivotally connected to the machine frame by at least one tilting cylinder arranged approximately vertically.

5. Apparatus according to claim 1, wherein the rotarty cutter head is exchangeable.

* * * * *